US007737938B2

(12) United States Patent
Gong et al.

(10) Patent No.: US 7,737,938 B2
(45) Date of Patent: Jun. 15, 2010

(54) DRIVING CIRCUIT FOR LCD BACKLIGHT

(75) Inventors: Jung Chul Gong, Seoul (KR); Byoung Own Min, Gyunggi-Do (KR); Sang Cheol Shin, Gyunggi-Do (KR); Chang Woo Ha, Gyunggi-Do (KR)

(73) Assignee: Samsung Electro-Mechanics Co., Ltd., Gyunggi-Do (KR)

( * ) Notice: Subject to any disclaimer, the term of this patent is extended or adjusted under 35 U.S.C. 154(b) by 683 days.

(21) Appl. No.: 11/696,529

(22) Filed: Apr. 4, 2007

(65) Prior Publication Data

US 2007/0236445 A1 Oct. 11, 2007

(30) Foreign Application Priority Data

Apr. 11, 2006 (KR) ..... 10-2006-0032990

(51) Int. Cl.
*G09G 3/36* (2006.01)

(52) U.S. Cl. ..... 345/102; 345/213

(58) Field of Classification Search ..... 345/55–108, 345/204–214, 690–697
See application file for complete search history.

(56) References Cited

U.S. PATENT DOCUMENTS 4,882,502 A 11/1989 Kobayashi
6,903,537 B2 * 6/2005 Tzeng et al. ..... 323/268
7,362,150 B2 * 4/2008 Fukumoto ..... 327/131
7,446,621 B2 * 11/2008 Chen et al. ..... 332/112
7,492,620 B2 * 2/2009 Fukumoto ..... 363/98
2005/0258782 A1 11/2005 Kanno et al.
2007/0120505 A1 * 5/2007 Moriyasu et al. ..... 315/309
2007/0228991 A1 * 10/2007 Shin et al. ..... 315/209 R

FOREIGN PATENT DOCUMENTS

JP 200455447 A 2/2004
KR 0122403 Y1 4/1997
KR 20-0304020 Y1 2/2003

* cited by examiner

*Primary Examiner*—David L Lewis
(74) *Attorney, Agent, or Firm*—Lowe Hauptman Ham & Berner LLP

(57) ABSTRACT

In a driving circuit for an LCD backlight, a fundamental wave generator generates a triangle wave signal and a square wave signal in accordance with time constant of a time constant circuit including a time constant capacitor. A PWM comparator compares a difference signal between a feedback voltage and a preset reference voltage with the triangle wave signal to generate a PWM signal in response to the comparison result. A signal synchronizer sets a connection node between the time constant capacitor and the fundamental wave generator and an output terminal of the square wave signal in accordance with a power level of the LCD backlight. Also, a driving signal generator generates a driving signal in response to the square wave signal from the fundamental wave generator and the PWM signal from the PWM comparator. The driving circuit enables PWM controlling integrated circuits to be synchronized together.

8 Claims, 6 Drawing Sheets

DRIVING CIRCUIT FOR LCD BACKLIGHT

CLAIM OF PRIORITY

This application claims the benefit of Korean Patent Application No. 2006-32990 filed on Apr. 11, 2006 in the Korean Intellectual Property Office, the disclosure of which is incorporated herein by reference.

BACKGROUND OF THE INVENTION

1. Field of the Invention

The present invention relates to a driving circuit for a liquid crystal display (LCD) backlight which enables synchronization of integrated circuits conducting pulse width modulation (PWM) control. More particularly, the present invention relates to a driving circuit for an LCD backlight which is applied to respective PWM controlling integrated circuits to synchronize the phases of driving signals from the PWM controlling integrated circuits, thereby synchronizing the PWM controlling integrated circuits together and preventing interference signals and noises that may otherwise occur due to asynchronization.

2. Description of the Related Art

In general, with a market for liquid crystal display (LCD) TVs and monitors expanding, LCD backlights are also growing in their size. Also, in order to enhance driving capacity of lamps such as a Cold Cathode Fluorescent Lamp (CCFL), a need has arisen to adopt at least two integrated circuits (ICs) in parallel. Here, in case of driving the integrated circuits, driving signals thereof should be synchronized in phases.

FIG. 1 is a configuration view illustrating a conventional LCD backlight driver.

Referring to FIG. 1, the conventional LCD backlight driver includes a time constant circuit 1, a first PWM controlling integrated circuit IC1 and a second PWM controlling integrated circuit IC2. The time constant circuit 1 provides time constant $\tau$ to determine a frequency of a driving signal. The first PWM controlling integrated circuit IC1 generates a first driving signal Sd1 in accordance with the time constant of the time constant circuit 1. The second PWM control integrated circuit IC2 generates a second driving signal Sd2 in accordance with the time constant of the time constant circuit 1.

The time constant circuit 1 includes a time constant capacitor CT for determining the time constant, and optionally a time constant resistor. The time constant capacitor CT and the time constant resistor can be variously connected to the time constant circuit 1.

Moreover, the first and second PWM controllers IC1 and IC2 each include a driving circuit for an LCD backlight for generating the driving signal. The driving circuit for the LCD backlight will be explained with reference to FIG. 2.

FIG. 2 is a configuration view illustrating a driving circuit for an LCD backlight in PWM controlling integrated circuits.

Referring to FIG. 2, the conventional driving circuit for the LCD backlight in the PWM controlling integrated circuits includes a fundamental wave generator 10, a PWM comparator 20, and a driving signal generator 30. The fundamental wave generator 10 generates a triangle wave and a square wave in accordance with time constant. The PWM comparator 20 compares a difference signal Vref between a feedback voltage Vfb and a preset reference voltage Vref to generate a PWM signal Spwm. The driving signal generator 30 generates a driving signal sd in response to the square wave from the fundamental wave generator 10 and the PWM signal Spwm from the PWM comparator 20.

FIG. 3 is a timing chart illustrating major signals of the driving circuit for the LCD backlight of FIG. 1. In FIG. 3, Sero denotes a difference signal between a feedback voltage Vfb and a reference voltage Vref, Sosc denotes a triangle wave signal generated from the fundamental wave generator 10, Sd denotes a driving signal, which includes a high signal HO and a low signal LO.

Referring to FIG. 3, as described above, the conventional driving circuit for the LCD backlight generates the driving signal including the high and low signals HO and LO in accordance with the difference signal Sero between the feedback voltage Vfb and the preset reference voltage Vref, and the triangle square wave signal Sosc.

In greater detail, referring to FIGS. 2 and 3, to generate the driving signal from the conventional driving circuit for the LCD backlight, the square wave from the fundamental wave generator 10 is compared with the PWM signal Spwm from the PWM comparator 20. Here, the high signal HO (or low signal LO) is outputted in the first period and the low signal LO (or high signal) is outputted in the second period. That is, the high and low signals HO and LO are outputted randomly without any priority given thereto.

As described above, in the conventional driving for the LCD backlight in which the at least two PWM controlling integrated circuits are driven in parallel, the driving signals are out of synchronization even with use of the same triangle wave signals since there is no priority between the high and low signals.

Accordingly, the driving signals are outputted randomly from the PWM controlling integrated circuits, failing to synchronize the output signals from the PWM controlling integrated circuits together. This causes interference of light and occurrence of noises in lamps such as the CCFL. This results in defects in the LCD backlight such as flickering.

SUMMARY OF THE INVENTION

The present invention has been made to solve the foregoing problems of the prior art and therefore an aspect of the present invention is to provide a driving circuit for an LCD backlight which enables synchronization of integrated circuits conducting pulse width modulation (PWM) control, and which is applied to the respective PWM controlling integrated circuits of the LCD backlight to synchronize the phases of driving signals from the PWM controlling integrated circuits, thereby synchronizing the PWM controlling integrated circuits together and preventing interference signals and noises that may otherwise occur due to asynchronization.

According to an aspect of the invention, the invention provides a driving circuit for an LCD backlight. The driving circuit for the LCD backlight includes a fundamental wave generator for generating a triangle wave signal and a square wave signal in accordance with time constant of a time constant circuit including a time constant capacitor; a pulse width modulation comparator for comparing a difference signal between a feedback voltage and a preset reference voltage with the triangle wave signal to generate a PWM signal in response to the comparison result; a signal synchronizer for setting a connection node between the time constant capacitor and the fundamental wave generator and an output terminal of the square wave signal in accordance with a power level of the LCD backlight; and a driving signal generator for generating a driving signal in response to the square wave signal from the fundamental wave generator and the PWM signal from the pulse width modulation comparator, whereby pulse width modulation controlling integrated circuits are synchronized together.

The fundamental wave generator includes a main oscillator for generating the triangle wave signal and a clock signal in accordance with the time constant; and a 2-divider for dividing the clock signal from the main oscillator by two to generate the square wave signal.

The pulse width modulation comparator includes an error comparator for comparing the feedback voltage with the preset reference voltage to generate the difference signal; and a pulse width modulation comparator for comparing the difference signal from the error comparator with the triangle wave signal form the main oscillator to generate the PWM signal in response to the comparison result.

The signal synchronizer includes a first switch for switching on/off the connection node between the time constant capacitor and the fundamental wave generator, and a ground, in accordance with the power level of the LCD backlight; and a second switch for switching on/off the output terminal of the square wave signal and a voltage terminal in accordance with the power level of the LCD backlight.

The first switch is adapted to switch on/off synchronously with the second switch in accordance with the power level of the LCD backlight. The first switch connects the connection node between the time constant capacitor and the fundamental wave generator to the ground when applied with a power voltage of the LCD backlight, and disconnects the connection node between the time constant capacitor and the fundamental wave generator from the ground when not applied with the power voltage of the LCD backlight.

The second switch connects the output terminal of the square wave signal of the fundamental wave generator to the voltage terminal when applied with a power voltage of the LCD backlight, and disconnects the output terminal of the square wave signal of the fundamental wave generator from the voltage terminal when not applied with the power voltage of the LCD backlight.

The driving signal generator includes an inverter for inverting the square wave signal from the fundamental wave generator to generate an inverted square wave signal; a first AND gate for logically multiplying the square wave signal from the fundamental generator by the PWM signal from the pulse width modulation comparator; and a second AND gate for logically multiplying the inverted square wave signal from the inverter by the PWM signal from the pulse width modulation comparator.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1:
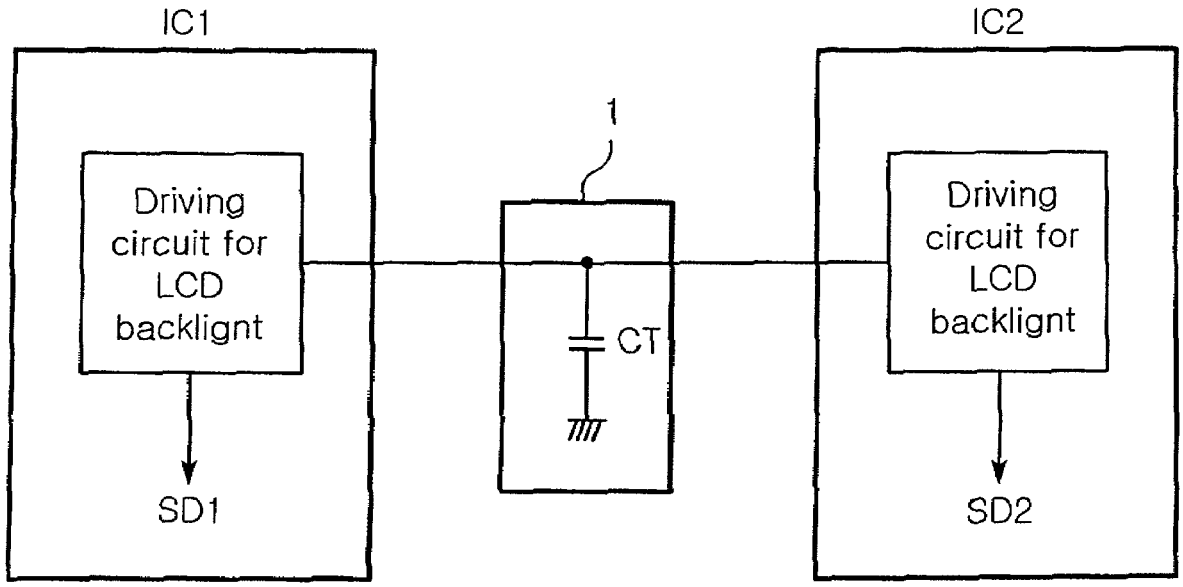
FIG. 1 is a configuration view illustrating a backlight driver for an LCD backlight according to the prior art.
Figure 2:
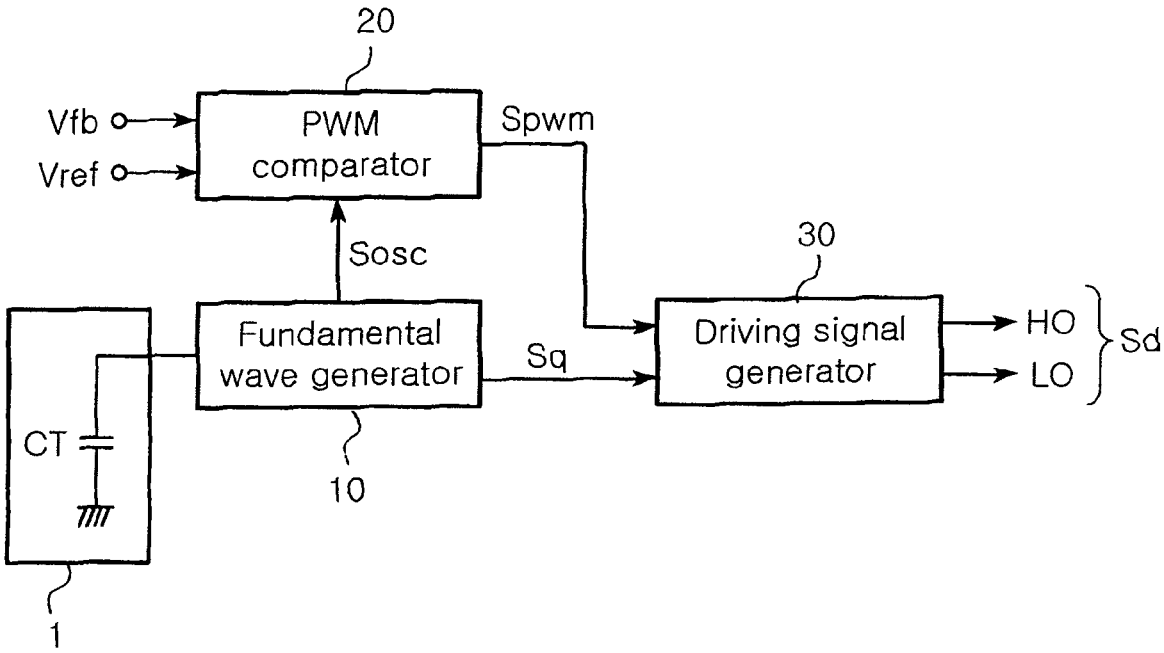
FIG. 2 is a configuration view illustrating a driving circuit for an LCD backlight in PWM controlling integrated circuits shown in FIG. 1.
Figure 3:
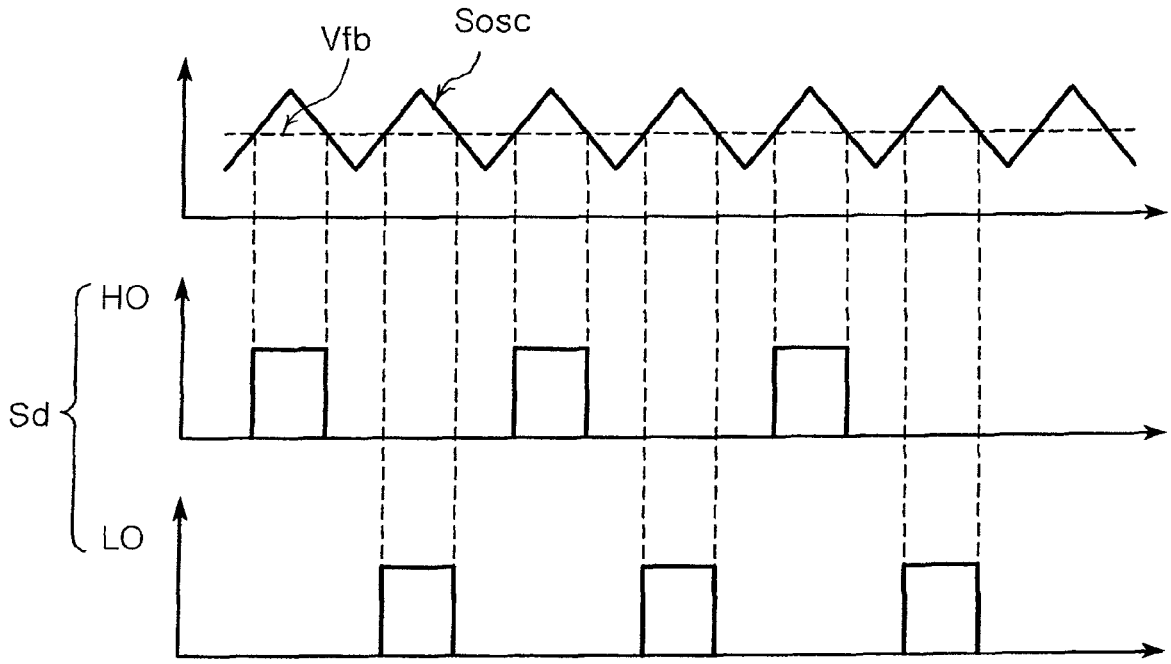
FIG. 3 is a timing chart illustrating major signals of the driving circuit for the LCD backlight of FIG. 1.
Figure 4:
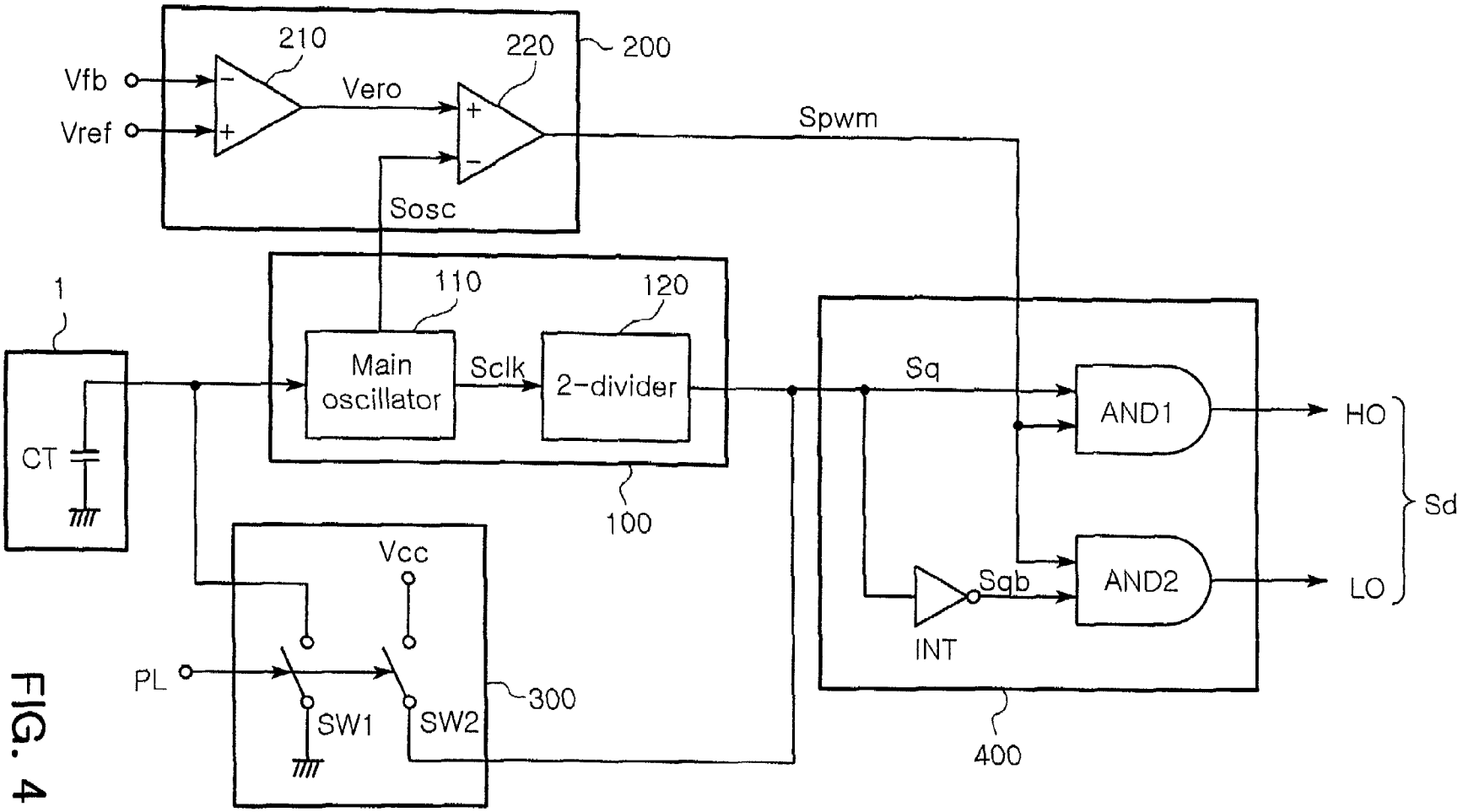
FIG. 4 is a configuration view illustrating a driving circuit for an LCD backlight according to the invention.

FIG. 4 is a configuration view illustrating a driving circuit for an LCD backlight according to the invention.

Referring to FIG. 4, the driving circuit for the LCD backlight of the invention includes a fundamental wave generator 100, a pulse width modulation (PWM) comparator 200, a signal synchronizer 300 and a driving signal generator 400. The fundamental wave generator 100 generates a triangle wave signal Sosc and a square wave signal Sq in accordance with time constant of a time constant circuit 1 including a time constant capacitor CT. The PWM comparator 200 compares a difference signal Sero between a feedback voltage Vfb and a preset reference voltage Vref with the triangle wave signal Sosc to generate a PWM signal Spwm in response to the comparison result. The signal synchronizer 300 sets a connection node between the time constant capacitor CT and the fundamental wave generator 100 and an output terminal of the square wave signal Sq in accordance with a power level PL of the LCD backlight. The driving signal generator Sd generates a driving signal Sd in response to the square wave signal Sq from the fundamental wave generator 100 and the PWM signal Spwm from the PWM comparator 200.

Here, the time constant circuit 1 may include the time constant capacitor CT, and optionally a time constant resistor to determine the time constant. The time constant capacitor CT and the time constant resistor can be connected to the time constant circuit 1 according to various methods as generally known.

The fundamental wave generator 100 includes a main oscillator 110 and a 2-divider 120. The main oscillator 110 generates the triangle wave Sosc and a clock signal Sclk in accordance with the time constant of the time constant circuit 1 including the time constant capacitor CT. The 2-divider divides the clock signal from the main oscillator 110 by two to generate the square wave signal Sq.

The PWM comparator 200 includes an error comparator 210 and a PWM comparator 220. The error comparator 210 compares the feedback voltage Vfb with the preset reference voltage Vref to generate the difference signal Sero. The PWM comparator compares the difference signal Sero from the error comparator with the triangle wave signal Sosc from the main oscillator 110 to generate the PWM signal in response to the comparison result.

The signal synchronizer 300 includes a first switch SW1 and a second switch SW2. The first switch SW1 switches on/off the connection node between the time constant capacitor CT and the fundamental wave generator 100, and a ground, in accordance with the power level PL of the LCD backlight. The second switch switches on/off the output terminal of the square wave signal Sq and a voltage terminal Vcc in accordance with the power level PL of the LCD backlight.

Here, the first switch SW1 is adapted to switch on/off synchronously with the second witch SW2 in accordance with the power level PL of the LCD backlight.

The first switch SW1 connects the connection node between the time constant capacitor CT and the fundamental wave generator 100 to the ground when applied with a power voltage of the LCD backlight, and disconnects the connection node between the time constant capacitor CT and the fundamental wave generator 100 from the ground when not applied with the power voltage of the LCD backlight.

Meanwhile, the second switch SW2 connects the output terminal of the square wave signal Sq of the fundamental wave generator 100 to the voltage terminal Vcc when applied with the power voltage of the LCD backlight, and disconnects the output terminal of the square wave signal Sq of the fundamental wave generator 100 from the voltage terminal Vcc when not applied with the power voltage of the LCD backlight.

The driving signal generator 400 includes an inverter 410, a first AND gate 420 and a second AND gate 430. The inverter 410 inverts the square wave signal Sq from the fundamental wave generator 100 to generate an inverted square wave signal Sqb. The first AND gate 420 logically multiplies the square wave signal Sq from the fundamental generator 100 by the PWM signal Spwm from the PWM comparator 200. The second AND gate 430 logically multiplies the inverted square wave signal Sqb from the inverter 410 by the PWM signal Spwm from the PWM comparator 200.

Figure 5:
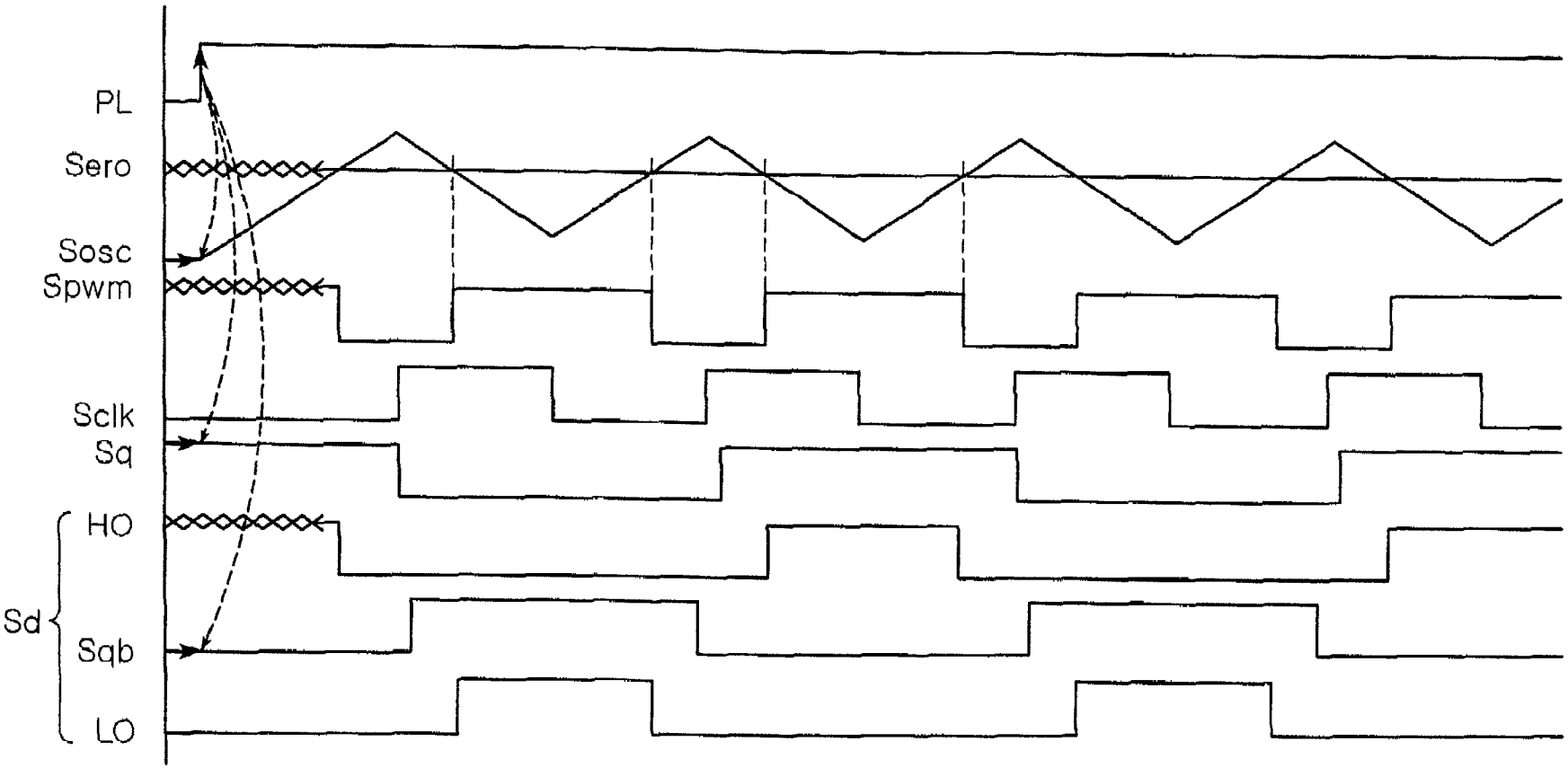
FIG. 5 is a timing chart illustrating major signals of the LCD backlight driving circuit of FIG. 4.

FIG. 5 is a timing chart illustrating major signals of the driving circuit for the LCD backlight of FIG. 4.

In FIG. 5, PL denotes a power level of the LCD backlight. With the LCD backlight turned on, the power level may change from low to high, or vice versa.

Sero denotes a difference signal outputted from the error comparator 210. Spwm denotes a signal outputted from the PWM comparator 200. Sclk represents a signal outputted from the main oscillator 110. Sq represents a square wave signal outputted from the fundamental generator 100. Sqb denotes an inverted square wave signal outputted from the inverter 410. Sd denotes a driving signal outputted from the driving signal generator 400 and includes first and second driving signals HO and LO.

Figure 6:
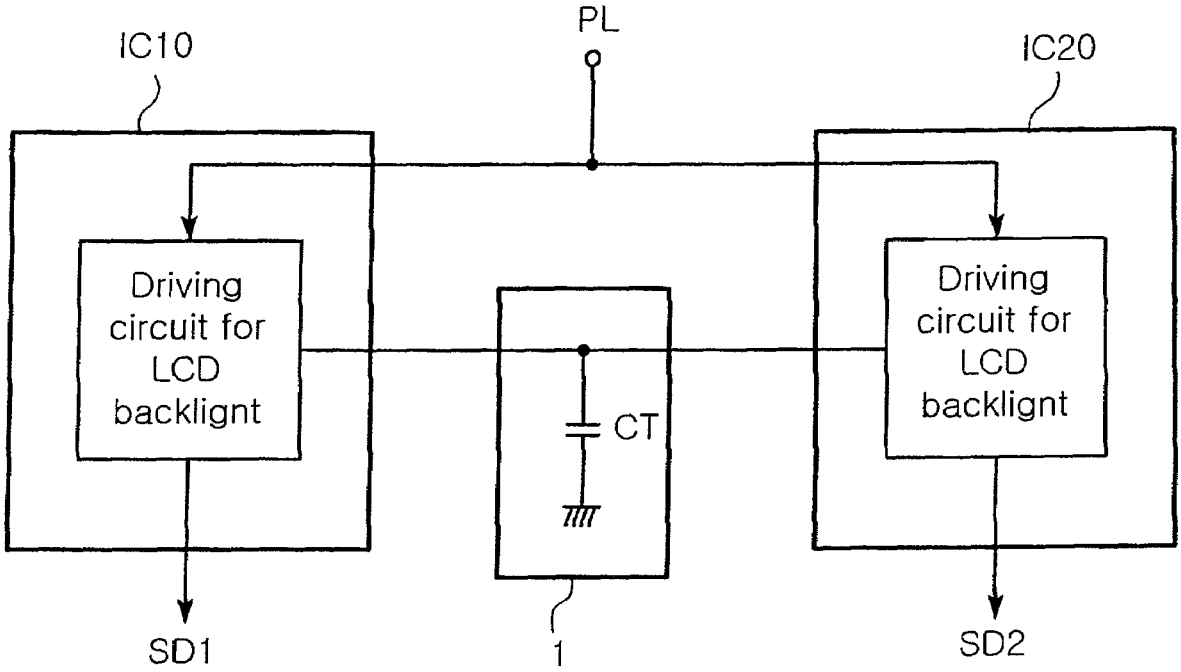
FIG. 6 is a configuration view illustrating an LCD backlight driver employing a driving circuit for an LCD backlight according to the invention.

FIG. 6 is a configuration view illustrating an LCD backlight driver employing the driving circuit for the LCD backlight of the invention.

The LCD backlight driver of FIG. 6 includes two PWM controlling integrated circuits IC10 and IC20, each of which includes the driving circuit for the LCD backlight of the invention shown in FIG. 4.

Here, the driving circuit for the LCD backlight is synchronized with a power level PL of the LCD backlight so that the PWM controlling integrated circuits IC10 and IC20 become synchronous with each other.

Operations and effects of the invention will be explained in detail hereunder with reference to the accompanying drawings.

The driving circuit for the LCD backlight of the invention is adopted for an LCD backlight system using a plurality of PWM controlling integrated circuits to drive a big backlight. The driving circuit enables the PWM controlling integrated circuits to be synchronized together, thereby operating the LCD backlight more efficiently and stably.

This will be explained with reference to FIGS. 4 to 6.

First, referring to FIG. 4, in the driving circuit for the LCD backlight of the invention, the fundamental wave generator 100 of the invention generates a triangle wave signal Sosc and a square wave signal Sq in accordance with time constant of a time constant circuit 1 including a time constant capacitor CT as shown in FIG. 5. Then the fundamental wave generator 100 outputs the triangle wave signal Sosc to the PWM comparator 200 and the square wave signal Sq to the driving signal generator 400.

The PWM comparator 200 compares a difference signal Sero between a feedback voltage Vfb of the LCD backlight and a preset reference voltage Vref with the triangle wave signal Sosc to generate a PWM signal Spwm in response to the comparison result as shown in FIG. 5 and outputs the PWM signal Spwm to the driving signal generator 400.

Here, the signal synchronizer 300 sets a connection node between the time constant capacitor CT and the fundamental wave generator 100 and an output terminal of the square wave signal Sq in accordance with a power level PL of the LCD backlight. Then the signal synchronizer synchronizes the triangle wave signal Sosc and the square wave signal Sq together, as shown in FIG. 5.

The driving signal generator 400 generates the driving signal Sd in response to the square wave signal Sq of the fundamental wave generator 100 and the PWM signal Spwm of the PWM comparator 200.

Referring to FIG. 4, the fundamental wave generator 100 will be explained in greater detail.

In FIG. 4, the main oscillator 110 of the fundamental wave generator 100 generates the triangle wave signal Sosc and the clock signal Sclk in accordance with time constant of the time constant circuit 1 including the time constant capacitor CT. Then the main oscillator 100 outputs the triangle wave signal Sosc to the PWM comparator 200 and the clock signal Sclk to the 2-divider 120.

The 2-divider 120 divides the clock signal Sclk from the main oscillator 110 by two to generate the square wave signal Sq, thereby outputting the same to the driving signal generator 400.

For example, in a case where the triangle wave signal Sosc and the clock signal Sclk each have a frequency of 8 MHz, the square wave signal Sq has a frequency of 4 MHz.

Referring to FIG. 4, the PWM comparator 200 will be explained in further detail.

In FIG. 4, the error comparator 210 of the PWM comparator 200 compares the feedback voltage Vfb with the preset reference voltage Vref to generate the difference voltage Sero, thereby outputting the same to the PWM comparator 220. The PWM comparator 220 compares the difference signal Sero from the error comparator 210 with the triangle wave signal Sosc from the main oscillator 110 to generate the PWM signal in response to the comparison result, thereby outputting the same to the driving signal generator 400.

Referring to FIG. 4, the signal synchronizer 300 will be explained in more detail.

In FIG. 4, the first switch SW1 of the signal synchronizer 300 switches on/off the connection node between the time constant capacitor CT and the fundamental wave generator 100, and the ground, in accordance with the power level PL of the LCD backlight. That is, the first switch SW1 connects the connection node between the time constant capacitor CT and the fundamental wave generator 100 to the ground when applied with a power voltage of the LCD backlight. Meanwhile, the first switch SW1 disconnects the connection node between the time constant capacitor CT and the fundamental wave generator 100 from the ground when not applied with the power voltage of the LCD backlight.

The second switch SW2 of the signal synchronizer 300 switches on/off the output terminal of the square wave signal Sq and a voltage terminal Vcc in accordance with the power level of the LCD backlight. That is, the second switch SW2 connects the output terminal of the square wave signal Sq of the fundamental wave generator 100 to the voltage terminal Vcc when applied with the power voltage of the LCD backlight. Meanwhile the second switch SW2 disconnects the output terminal of the square wave signal Sq of the fundamental wave generator 100 from the voltage terminal Vcc when not applied with the power voltage of the LCD backlight.

Here, the first switch SW1 is adapted to switch on/off synchronously with the second switch SW2 in accordance with the power level PL of the LCD backlight.

For example, in a case where the power level PL becomes high with the power voltage applied to the LCD backlight, both the first and second switches SW1 and SW2 are turned on so that the connection node between the fundamental wave generator 100 and the time constant capacitor CT is connected to the ground. This accordingly turns the triangle wave signal Sosc into a low level, as shown in FIG. 5. At the same time, the output terminal of the square wave signal Sq of the fundamental wave generator 100 is connected to the voltage terminal Vcc so that the square wave signal Sq is turned to a high level and an inverted square wave signal Sqb is turned to a low level as shown in FIG. 5.

With the signal synchronizer 300 operating as just described, as shown in FIG. 5, the power level PL of the LCD backlight transits to a higher level when applied with the power voltage of the LCD backlight. Correspondingly, the triangle wave signal Sosc, the square wave signal Sq and the inverted square wave signal Sqb from the PWM comparator 200 are synchronized with one another.

In this fashion, the triangle wave signal Sosc, the square wave signal Sq and the inverted square wave signal Sqb from the PWM comparator 200 become synchronous with one another. Also, as shown in FIG. 6, the PWM controlling integrated circuits IC10 and IC20 each include the driving circuit for the LCD backlight, which operates in synchronization with the power level PL of the LCD backlight. In consequence, the PWM controlling integrated circuits IC10 and IC20, which are synchronized with each other, can output the synchronous driving signals Sd1 and Sd2.

Furthermore, referring to FIG. 4, the driving signal generator 400 will be explained in greater detail.

In FIG. 4, the inverter 410 of the driving signal generator 400 inverts the square wave signal Sq from the fundamental wave generator 100 to generate the inverted square wave signal Sqb, and then outputs the inverted square wave signal Sqb to the first and second AND gates 420 and 430.

The first AND gate 420 logically multiplies the square wave signal Sq from the fundamental generator 100 by the PWM signal Spwm from the PWM comparator 200, thereby outputting a first driving signal HO as shown in FIG. 5.

Meanwhile, the second AND gate 430 logically multiplies the inverted signal Sqb from the inverter 410 by the PWM signal Spwm from the PWM comparator, thereby outputting a second driving signal HO as shown in FIG. 5.

As set forth above, according to exemplary embodiments of the invention, a driving circuit for an LCD backlight enables synchronization of PWM controlling integrated circuits and is applied to the respective PWM controlling integrated circuits of the LCD backlight to synchronize the phases of driving signals from the PWM controlling integrated circuits. This accordingly synchronizes the PWM controlling integrated circuits together and prevents interference signals and noises that may otherwise arise owing to asynchronization.

That is, as described above, the PWM controlling integrated circuits driven in parallel, synchronize output signals in phases, and driving signals from the PWM controlling integrated circuits. This prevents interference signals and noises, also allowing multi-lamps resulting from a big LCD screen to be easily driven. In addition, the PWM controlling integrated circuits can be driven stably in parallel.

While the present invention has been shown and described in connection with the preferred embodiments, it will be apparent to those skilled in the art that modifications and variations can be made without departing from the spirit and scope of the invention as defined by the appended claims.

What is claimed is:

1. A driving circuit for a liquid crystal display backlight comprising:

a fundamental wave generator for generating a triangle wave signal and a square wave signal in accordance with time constant of a time constant circuit including a time constant capacitor;

a pulse width modulation comparator for comparing a difference signal between a feedback voltage and a preset reference voltage with the triangle wave signal to generate a pulse width modulation signal in response to the comparison result;

a signal synchronizer for setting a connection node between the time constant capacitor and the fundamental wave generator and an output terminal of the square wave signal in accordance with a power level of the liquid crystal display backlight; and a driving signal generator for generating a driving signal in response to the square wave signal from the fundamental wave generator and the pulse width modulation signal from the pulse width modulation comparator, whereby pulse width modulation controlling integrated circuits are synchronized together.

2. The driving circuit for the liquid crystal display backlight according to claim 1, wherein the fundamental wave generator comprises:

a main oscillator for generating the triangle wave signal and a clock signal in accordance with the time constant; and a 2-divider for dividing the clock signal from the main oscillator by two to generate the square wave signal.

3. The driving circuit for the liquid crystal display backlight according to claim 2, wherein the pulse width modulation comparator comprises:

an error comparator for comparing the feedback voltage with the preset reference voltage to generate the difference signal; and a pulse width modulation comparator for comparing the difference signal from the error comparator with the triangle wave signal form the main oscillator to generate the pulse width modulation signal in response to the comparison result.

4. The driving circuit for the liquid crystal display backlight according to claim 1, wherein the signal synchronizer comprises:

a first switch for switching on/off the connection node between the time constant capacitor and the fundamental wave generator, and a ground, in accordance with the power level of the liquid crystal display backlight; and a second switch for switching on/off the output terminal of the square wave signal and a voltage terminal in accordance with the power level of the liquid crystal display backlight.

5. The driving circuit for the liquid crystal display backlight according to claim 4, wherein the first switch is adapted to switch on/off synchronously with the second switch in accordance with the power level of the liquid crystal display backlight.

6. The driving circuit for the liquid crystal display backlight according to claim 4, wherein the first switch connects the connection node between the time constant capacitor and the fundamental wave generator to the ground when applied with a power voltage of the liquid crystal display backlight, and disconnects the connection node between the time constant capacitor and the fundamental wave generator from the ground when not applied with the power voltage of the liquid crystal display backlight.

7. The driving circuit for the liquid crystal display backlight according to claim 4, wherein the second switch connects the output terminal of the square wave signal of the fundamental wave generator to the voltage terminal when applied with a power voltage of the liquid crystal display backlight, and disconnects the output terminal of the square wave signal of the fundamental wave generator from the voltage terminal when not applied with the power voltage of the liquid crystal display backlight.

8. The driving circuit for the liquid crystal display backlight according to claim 1, wherein the driving signal generator comprises:

an inverter for inverting the square wave signal from the fundamental wave generator to generate an inverted square wave signal;

a first AND gate for logically multiplying the square wave signal from the fundamental generator by the pulse width modulation signal from the pulse width modulation comparator; and a second AND gate for logically multiplying the inverted square wave signal from the inverter by the pulse width modulation signal from the pulse width modulation comparator.

* * * * *